US012553326B2

(12) United States Patent
Willberg

(10) Patent No.: US 12,553,326 B2
(45) Date of Patent: Feb. 17, 2026

(54) SYSTEMS AND METHODS FOR FACILITATING EFFECTIVE FRACTURE INITIATION

(71) Applicant: Schlumberger Technology Corporation, Sugar Land, TX (US)

(72) Inventor: Dean Michael Willberg, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/794,744

(22) Filed: Aug. 5, 2024

(65) Prior Publication Data

US 2026/0036030 A1 Feb. 5, 2026

(51) Int. Cl.
*E21B 43/263* (2006.01)
*E21B 43/11* (2006.01)

(52) U.S. Cl.
CPC ..... *E21B 43/263* (2013.01); *E21B 43/11* (2013.01)

(58) Field of Classification Search
CPC ..... E21B 43/11; E21B 43/263
See application file for complete search history.

(56) References Cited

U.S. PATENT DOCUMENTS

| | | | | |
|---|---|---|---|---|
| 3,153,449 | A * | 10/1964 | Lebourg | E21B 43/117 166/100 |
| 3,433,305 | A * | 3/1969 | Bell | E21B 43/1195 166/165 |
| 5,072,791 | A * | 12/1991 | Whitebay | C09K 8/60 166/278 |
| 5,159,979 | A | 11/1992 | Jennings, Jr. | |
| 2011/0174486 | A1* | 7/2011 | Walker | E21B 43/117 166/297 |
| 2014/0332214 | A1 | 11/2014 | Zhou | |
| 2018/0327886 | A1* | 11/2018 | Marya | E21B 41/00 |
| 2020/0392824 | A1 | 12/2020 | Batarseh | |
| 2021/0189855 | A1* | 6/2021 | Purdy | C09K 8/602 |

* cited by examiner

*Primary Examiner* — D. Andrews
(74) *Attorney, Agent, or Firm* — Jeffrey D. Frantz

(57) ABSTRACT

Systems and methods presented herein are configured to facilitate effective fracture initiation. For example, a method includes deploying a tool string into a wellbore extending through a subterranean formation, wherein the tool string comprises a perforating tool and a mechanical reactant delivery assembly; releasing a plurality of chemical reactants from the mechanical reactant delivery assembly while the tool string is deployed within the wellbore to enable the plurality of chemical reactants to mix to form a breakdown fluid; and firing one or more explosive charges of the perforating tool to inject the breakdown fluid into the subterranean formation to initiate one or more fractures in the subterranean formation.

11 Claims, 5 Drawing Sheets

SYSTEMS AND METHODS FOR FACILITATING EFFECTIVE FRACTURE INITIATION

BACKGROUND

The present disclosure generally relates to systems and methods for facilitating effective fracture initiation.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Hydraulic fracture initiation is complex, poorly understood, and incompletely modeled. However, breakdown and initiation are critical to the success or failure of hydraulic fracture treatments, especially for multi-stage horizontal wells, because they create the architecture of the fracture network in the near-wellbore zone. This architecture—the arrangement of near-wellbore fractures that subsequently grow in time—are created by the first few barrels of fluid that are pumped through the perforations. Therefore, the first few barrels of fluid of any hydraulic fracturing treatment are extremely important, but unfortunately most often underappreciated.

Although it can be argued that fracture complexity in the far field zone (i.e., far from the wellbore) is desired—to expose more productive rock surface area—complexity in the near wellbore zone invariably has a negative impact on both fracture placement and subsequent production. Near-wellbore complexity causes the near-wellbore tortuosity that throttles treating pressure for the duration of the treatment. Fracture complexity in the near-wellbore region can significantly impede proppant placement deeper into the fracture—potentially leading to early screen-outs. Furthermore, these negative impacts are exacerbated when multiple perforation clusters are simultaneously treated during one stage. Tortuosity depends on the local rock fabric and can be highly variable from one perforation cluster to the next. The variation in tortuosity from one perforation cluster to the next means that each perforation cluster experiences its own random "tortuosity choke". Therefore, some perforation clusters will take more fluid and proppant than others. Proppant distribution will not be uniform along the wellbore within a stage, and it is possible that some fractures will grow wildly out of zone.

Although multi-stage hydraulic fracturing with pump-down perforations has developed into a highly orchestrated, highly efficient process, the fracture initiation process for the most part has been left uncontrolled. Significant resources, years of engineering, and endless conference proceedings have gone into perforation gun design, shot patterns, perforation cluster patterns, limited entry strategies, and so forth. These considerable efforts primarily influence the flow pattern through the rock within a few inches (or maybe a foot) from the wellbore. However, the fracture network created by the first few barrels of fluid pumped through the perforations that extends through the rock away from the wellbore has received little engineering attention—and practically no advanced technology.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a method that includes deploying a tool string into a wellbore extending through a subterranean formation. The tool string includes a perforating tool and a mechanical reactant delivery assembly. The method also includes releasing a plurality of chemical reactants from the mechanical reactant delivery assembly while the tool string is deployed within the wellbore to enable the plurality of chemical reactants to mix to form a breakdown fluid. The method further includes firing one or more explosive charges of the perforating tool to inject the breakdown fluid into the subterranean formation to initiate one or more fractures in the subterranean formation.

In addition, certain embodiments of the present disclosure include a downhole tool string that includes a mechanical reactant delivery assembly configured to store a plurality of chemical reactants configured to be released by the mechanical reactant delivery assembly and mix to form a breakdown fluid. The downhole tool string also includes a perforating tool comprising one or more explosive charges configured to be fired to inject the breakdown fluid into a subterranean formation when the perforating tool is deployed within a wellbore extending through the subterranean formation.

In addition, certain embodiments of the present disclosure include a method that includes deploying a tool string into a wellbore extending through a subterranean formation. The tool string includes a perforating tool and a mechanical reactant delivery assembly. The method also includes releasing a plurality of chemical reactants from the mechanical reactant delivery assembly while the tool string is deployed within the wellbore to enable the plurality of chemical reactants to mix to form a breakdown fluid. The method further includes firing one or more explosive charges of the perforating tool to inject the breakdown fluid into the subterranean formation to initiate one or more fractures in the subterranean formation. In addition, the method includes pumping a follow-up fluid into the subterranean formation subsequent to injecting the breakdown fluid into the subterranean formation.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
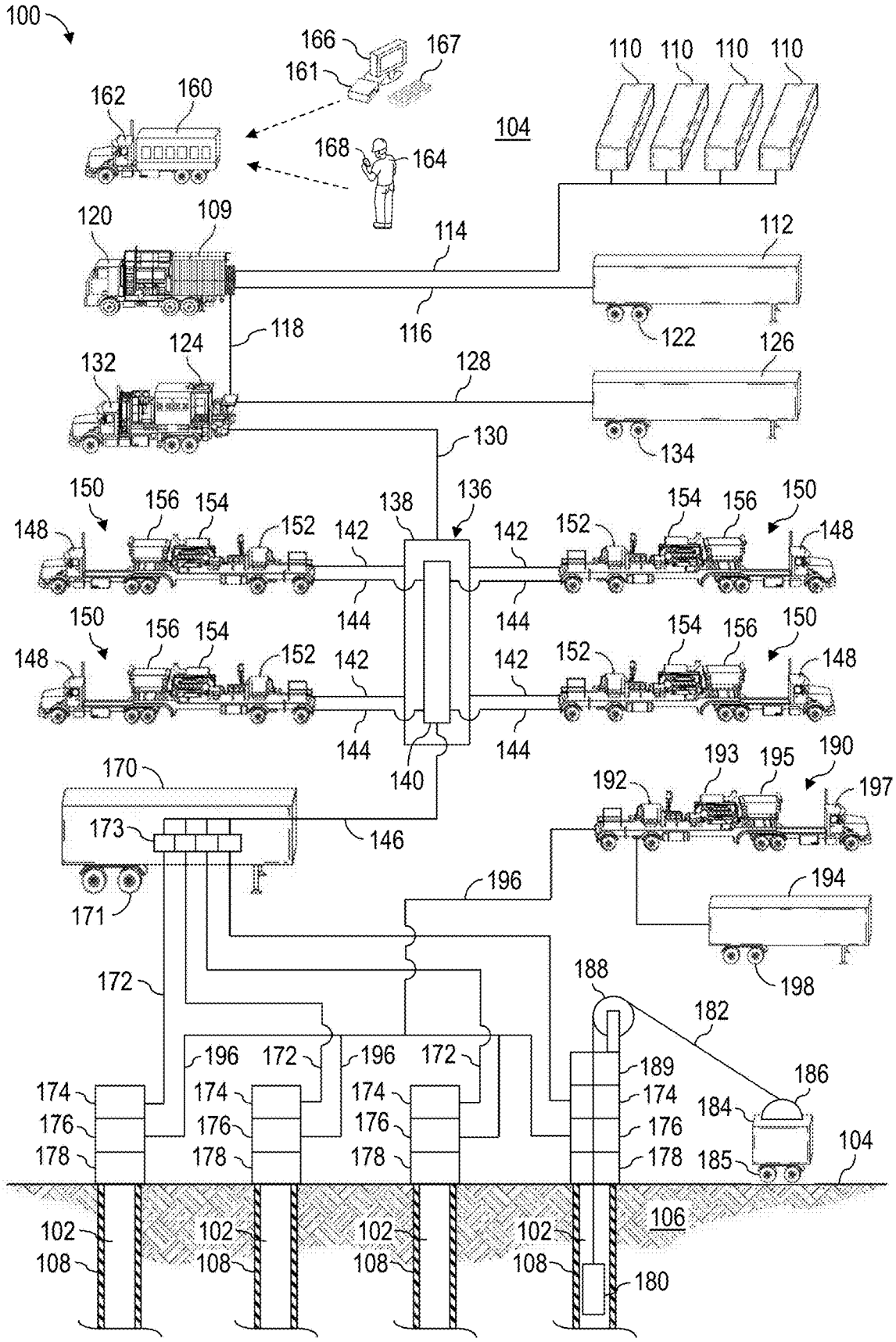
FIG. 1 is a schematic view of at least a portion of an example implementation of a wellsite system, in accordance with embodiments of the present disclosure.

One or more specific embodiments of the present disclosure will be described herein. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to describe certain embodiments more clearly.

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "continuous", "continuously", or "continually" are intended to describe operations that are performed without any significant interruption. For example, as used herein, control commands may be transmitted to certain equipment every five minutes, every minute, every 30 seconds, every 15 seconds, every 10 seconds, every 5 seconds, or even more often, such that operating parameters of the equipment may be adjusted without any significant interruption to the closed-loop control of the equipment. In addition, as used herein, the terms "automatic", "automated", "autonomous", and so forth, are intended to describe operations that are performed or caused to be performed, for example, by a control system (i.e., solely by the control system, without human intervention). Indeed, it will be appreciated that the analysis and control system described herein may be configured to perform any and all of the data processing functions described herein automatically.

In addition, as used herein, the term "substantially similar" may be used to describe values that are different by only a relatively small degree relative to each other. For example, two values that are substantially similar may be values that are within 10% of each other, within 5% of each other, within 3% of each other, within 2% of each other, within 1% of each other, or even within a smaller threshold range, such as within 0.5% of each other or within 0.1% of each other.

As discussed above, it is relatively difficult to control, or even influence, fracture initiation and the earliest stages of propagation. In general, there are three main reasons why this is so. First, the physical properties of the wellbore volume of fluid left over from previous stages or previous wellbore operations is poorly suited for fracture initiation, and there is a lot of it. This fluid is usually a relatively low-viscosity brine left over after the pump-down perforation stage, and there can be hundreds of barrels in the wellbore. This, unfortunately, is the fluid that creates the near-wellbore fracture architecture in today's hydraulic fracturing operations. By the time that the wellbore volume is pumped away, and a fluid prepared at the surface reaches the perforations the fracture tips can be hundreds of feet away from the wellbore. Therefore, in most—if not all—cases, the architecture of the new-wellbore region of the fracture is created with relatively low-viscosity fluids.

Second, pump rates are not ideal for creating optimum near-wellbore fracture geometry during the first few seconds to minutes of the treatment. Safety and equipment concerns rightfully dominate rate and pressure settings at this critical point in the treatment—rock fabric and fracture complexity considerations are of secondary importance. However, this means that the near-wellbore region of the hydraulic fracture network is created with a relatively low-viscosity fluid pumped at relatively low rates, which are less than ideal for effective fracture propagation in complex heterogeneous rock lithologies.

Third, rock fabric is a dominant factor establishing near-wellbore fracture complexity. Heterogeneities in the formation's texture, coupled with the local stress state, direct where the fracture grows. This effect is exacerbated when relatively low-viscosity fluids are injected at relatively low injection rates into highly heterogeneous rock types such as shales. The impact of formation heterogeneity on fracture complexity is well documented in laboratory studies, interpretation of field results, and has been modeled from first principles.

Fracturing with a relatively high propagation pressure—a relatively high-viscosity fluid at a relatively high rate—is the only way to "force" fractures to breakdown through laminations, pre-existing fractures, and drilling-induced-damage within the heterogeneous rock surrounding the wellbore. It is noted that using relatively high-viscosity fluids to breakdown fractures in problematic rock was a standard practice well known to previous generations of the stimulation community. However, this method is not used much today because it is generally incompatible with the operational constraints imposed by unconventional horizontal wellbore multi-stage fracturing workflows.

Therefore, the industry needs fracture breakdown and initiation methods compatible with the current horizontal wellbore multi-stage fracturing workflows and which have the following features:

1. Since pump rates at the beginning of a treatment are primarily dictated by safety, operational and equipment issues, the techniques described herein should not be heavily dependent on the precise control of pump rates (e.g., it will need to live with what it gets). Therefore, the methods should be based on placing a relatively high-viscosity (and/or reactive) fluid pill across the perforation clusters in one fracturing stage.
2. The process needs to be correctable. Multi-stage fracturing is highly orchestrated. If there is an upset with the execution of the techniques described herein, it should be readily and quickly correctable.
3. The properties of the fluid system must be coordinated with the delivery and placement method.

The embodiments described herein include five separate, but potentially related, techniques that can be used either individually or in concert with each other, including:

1. A mechanical assembly (referred to as a "canister" herein) that is attached to, or part of, the perforating gun (or other tool) that is loaded with concentrated viscosifiers, crosslinking agents, and/or activating agents. These various chemicals are referred to as the "reactants" herein.
2. A method of releasing and mixing the reactants with the fluid that is in the wellbore to produce a gel, suspension, or slurry that has higher viscosity than the typical pump-down or flush fluids normally present.
3. The chemical composition of the reactants, the chemical composition of the fluid used to pump down the gun, and the resultant composition of the mixed fluid. This mixed fluid will be referred to as the "breakdown" fluid herein.
4. A method of initiating hydraulic fracturing of the formation with the breakdown fluid created by the downhole assembly mentioned in number 3.
5. A method of using "follow-up" fluids that are pumped in the early stages of the treatment, after number 4, to maximize the performance of the breakdown fluid, and potentially correct for any deleterious effects caused by residual breakdown fluids.

FIG. 1 is a schematic view of at least a portion of an example implementation of a wellsite system 100, in accordance with embodiments of the present disclosure. FIG. 1 illustrates multiple wellbores 102 each extending from a terrain surface of a wellsite 104, a partial sectional view of a subterranean formation 106 penetrated by the wellbores 102, and various pieces of wellsite equipment or components of the wellsite system 100 located at the wellsite 104. The wellsite system 100 may facilitate recovery of oil, gas, and/or other materials that are trapped in the subterranean formation 106. In certain embodiments, each wellbore 102 may include a casing 108 secured by cement (not shown). The wellsite system 100 may be operable to transfer various materials and additives from corresponding sources to a destination location for blending or mixing and subsequent injection into one or more of the wellbores 102 during fracturing and other stimulation operations. In certain embodiments, such operations may be partially or fully automated.

In certain embodiments, the wellsite system 100 may include a mixing unit 109 (referred to hereinafter as a "mixer") fluidly connected with one or more tanks 110 and a container 112. In certain embodiments, the container 112 may contain a first material and the tanks 110 may contain a liquid. In certain embodiments, the first material may be or include a hydratable material or gelling agent, such as cellulose, clay, galactomannan, guar, polymers, synthetic polymers, and/or polysaccharides, among other examples. In addition, in certain embodiments, the liquid may be or include an aqueous fluid, such as water or an aqueous solution including water, among other examples. In certain embodiments, the mixer 109 may be operable to receive the first material and the liquid, via two or more conduits or other material transfer means (hereafter simply "conduits") 114, 116, and mix or otherwise combine the first material and the liquid to form a base fluid, which may be or include what is known in the art as a gel. In certain embodiments, the mixer 109 may then discharge the base fluid via one or more conduits 118.

In certain embodiments, the wellsite system 100 may further include another mixer 124 fluidly connected with the mixer 109 and another container 126. In certain embodiments, the container 126 may contain a second material that may be appreciably different than the first material. For example, the second material may be or include a proppant material, such as quartz, sand, sand-like particles, silica, and/or propping agents, among other examples. In certain embodiments, the mixer 124 may be operable to receive the base fluid from the mixer 109 via the one or more conduits 118, and the second material from the container 126 via one or more conduits 128, and mix or otherwise combine the base fluid and the second material to form a mixed fluid, which may be or include what is known in the art as a fracturing fluid. In certain embodiments, the mixer 124 may then discharge the mixed fluid via one or more conduits 130.

In certain embodiments, the mixed fluid may be communicated from the mixer 124 to a common manifold 136 via the one or more conduits 130. In certain embodiments, the common manifold 136 may include a low-pressure distribution manifold 138, a high-pressure collection and discharge manifold 140, as well as various valves and diverters, which may be collectively operable to direct the flow of the mixed fluid in a predetermined manner. In certain embodiments, the common manifold 136 may receive the mixed fluid from the one or more conduits 130 and distribute the mixed fluid to a fleet of pump units 150 via the low-pressure distribution manifold 138. The common manifold 136 may be known in the art as a missile or a missile trailer. Although the fleet is illustrated as including four pump units 150, in other embodiments, the fleet may include other quantities of pump units 150 within the scope of the present disclosure.

Each pump unit 150 may include a pump 152, a prime mover 154, and perhaps a heat exchanger 156. In certain embodiments, each pump unit 150 may receive the mixed fluid from a corresponding outlet of the low-pressure distribution manifold 138 of the common manifold 136, via one or more conduits 142, and discharge the mixed fluid under pressure into a corresponding inlet of the high-pressure collection and discharge manifold 140 via one or more conduits 144. In certain embodiments, the mixed fluid may then be discharged from the high-pressure collection and discharge manifold 140 via one or more conduits 146.

The tanks 110, the containers 112, 126, the mixers 109, 124, the pump units 150, the manifold 136, and the conduits 114, 116, 118, 128, 130, 142, 144, 146 may collectively form a treatment (e.g., stimulation) fluid system. As described herein, the treatment fluid system of the wellsite system 100 may be operable to transfer additives and produce a fracturing fluid that may be pressurized and injected into a selected wellbore 102 during hydraulic fracturing operations. However, it is to be understood that the treatment fluid system may also or instead be operable to transfer other additives and mix other treatment fluids that may be pressurized and injected into the selected wellbore 102 during other well and/or reservoir treatment operations, such as acidizing operations, chemical injection operations, and other stimulation operations, among other examples. Accordingly, unless described otherwise, the one or more mixed fluids being produced and pressurized by the treatment fluid system for injection into a selected wellbore 102 may be referred to hereinafter simply as "a treatment fluid."

In certain embodiments, the treatment fluid may be received by a frac manifold 170, which may selectively distribute the treatment fluid between the wellbores 102 via a plurality of corresponding fluid conduits 172 extending between the frac manifold 170 and each wellbore 102. In certain embodiments, the frac manifold 170 may include a plurality of remotely operated fluid flow control valves 173 (e.g., frac valves, shut-off valves), each remotely operable to fluidly connect (and disconnect) the fluid conduit 146 with a selected one or more of the fluid conduits 172 and, thus, facilitate injection of the treatment fluid into a selected one or more of the wellbores 102. The frac manifold 170 may be known in the art as a zipper manifold.

Each wellbore 102 may be capped by a plurality (e.g., a stack) of fluid flow control devices 174, 176, which may include or form a Christmas tree (e.g., a frac tree) including fluid flow control valves (e.g., master valves, wing valves, swab valves, etc.), spools, flow crosses (e.g., goat heads, frac heads, etc.), and fittings individually and/or collectively operable to direct and control (e.g., permit and prevent) flow of the treatment fluid into the wellbore 102 and to direct and control flow of formation fluids out of the wellbore 102. In certain embodiments, the fluid flow control valves of the fluid flow control device 174, 176 may be operable to close selected tubulars or pipes, such as the casing 108 or production tubing extending within the wellbore 102, to selectively facilitate fluid access to the wellbore 102. In certain embodiments, the fluid flow control devices 174, 176 may also include or form a blow-out preventer (BOP) stack selectively operable to prevent flow of the formation fluids out of the wellbore 102. In certain embodiments, the fluid flow control devices 174, 176 may be directly or indirectly mounted on top of a wellhead 178 (e.g., tubing head adapter) terminating the wellbore 102 at the surface of the wellsite 104. In certain embodiments, each fluid flow control valve 173 of the frac manifold 170 may be fluidly connected with a corresponding fluid flow control device 174 via one or more fluid conduits 172, to facilitate selective fluid connection between the common manifold 136 and one or more of the wellbores 102. Thus, the fluid flow control valves 173 of the frac manifold 170 and the fluid flow control valves of the fluid flow control devices 174, 176 may collectively form a fluid flow control valve system operable to fluidly connect (and disconnect) one of the treatment fluid system and a pump-down system, as described herein, with a selected one or more of the wellbores 102.

In certain embodiments, a downhole intervention and/or sensor assembly, referred to herein as a tool string 180, may be conveyed within a selected one of the wellbores 102 via a conveyance line 182 operably coupled with one or more pieces of equipment at the wellsite 104. In certain embodiments, the tool string 180 may include a perforating tool operable to perforate the casing 108 and a portion of the formation 106 surrounding the wellbore 102 during perforating operations. In certain embodiments, the conveyance line 182 may be or include a cable, a wireline, a slickline, a multiline, an e-line, coiled tubing, and/or other conveyance means.

In certain embodiments, the conveyance line 182 may be operably connected with a conveyance device 184 (e.g., a wireline or coiled tubing conveyance unit) operable to apply an adjustable tension to the tool string 180 via the conveyance line 182 to convey the tool string 180 along the wellbore 102. In certain embodiments, the conveyance device 184 may be or include a winch conveyance system including a reel or drum 186 storing thereon a wound length of the conveyance line 182. The drum 186 may be rotated by a rotary actuator (e.g., an electric motor, a hydraulic motor, etc.) (not shown) to selectively unwind and wind the conveyance line 182 to apply an adjustable tensile force to the tool string 180 to selectively convey the tool string 180 into and out of the wellbore 102. In certain embodiments, the conveyance line 182 may be directed, guided, and/or injected (e.g., pushed downhole) into the wellbore 102 by an injection device 188 (e.g., a sheave, a pulley, a coiled tubing injector), one or more of which may be supported above the wellbore 102 via a mast, a derrick, a crane, and/or another support structure (not shown). In certain embodiments, the conveyance line 182 may include and/or be operable in conjunction with means for communication between the tool string 180, the conveyance device 184, and/or one or more other portions of the surface equipment, including a tool string control system.

The tool string 180 may be deployed into or retrieved from the wellbore 102 via the conveyance device 184 through the fluid flow control devices 174, 176, the wellhead 178, and/or a sealing and alignment assembly 189 mounted on the fluid flow control devices 174, 176 and operable to seal the conveyance line 182 during deployment, conveyance, intervention, and other wellsite operations performed via the tool string 180. The injection device 188 may, thus, guide the conveyance line 182 between the conveyance device 184 and the sealing and alignment assembly 189. In certain embodiments, the sealing and alignment assembly 189 may include a lock chamber (e.g., a lubricator, an airlock, a riser, etc.) mounted on the fluid flow control devices 174, 176, and a stuffing box operable to seal around the conveyance line 182 at the top of the lock chamber. In certain embodiments, the stuffing box may be operable to seal around an outer surface of the conveyance line 182, such as via annular packings applied around the surface of the conveyance line 182 and/or by injecting a fluid between the outer surfaces of the conveyance line 182 and an inner wall of the stuffing box.

In certain embodiments, the sealing and alignment assembly 189 and the injection device 188 may be disconnected from above a wellbore 102 that was perforated and is now ready for stimulation (e.g., fracturing operations), and may be installed or connected above a wellbore 102 that is to be perforated in preparation for stimulation. In certain embodiments, the sealing and alignment assembly 189 and the injection device 188 may be moved from wellbore 102 to wellbore 102 and supported above a wellbore 102 by a crane or other lifting equipment. The conveyance device 184, the sealing and alignment assembly 189, the injection device 188, the tool string 180, and the conveyance line 182 may collectively form at least a portion of a perforating system operable to convey the tool string 180 (including a perforating tool) within and out of a wellbore 102 and to perforate the wellbore 102.

In certain embodiments, the wellsite system 100 may further include a pump-down system operable to inject a fluid (e.g., water) into a selected one of the wellbores 102 to perform pump-down operations to convey the tool string 180 to an intended depth along the wellbore 102. The pump-down operations may be utilized to move the tool string 180 along the wellbore 102 to facilitate wellbore plugging and perforating ("plug and perf") operations. For example, the tool string 180 may be conveyed along the wellbore 102 to fluidly isolate an upper formation zone that has not yet been perforated from a lower formation zone that has already been perforated, and then perforate the upper formation zone. In certain embodiments, the pumping system may include a pump unit 190 operable to inject the fluid from a fluid container 194 into the selected one of the wellbores 102 containing the tool string 180 via a corresponding fluid flow control device 176 (or wellhead 178). Each pump unit 190 may include a fluid pump 192, a prime mover 193 for actuating the fluid pump 192, and perhaps a heat exchanger 195. In certain embodiments, the fluid pump 192 of the pump unit 190 may be fluidly connected with the fluid container 194 and with each fluid flow control device 176 (which may be or form a portion of the wellhead 178) via a plurality of conduits 196, which may be or form a fluid distribution manifold. In certain embodiments, pump-down and plug and perf operations may be performed in a selected wellbore 102 while stimulation operations are simultaneously performed in one or more other wellbores 102. Accordingly, when a wellbore 102 is selected to be plugged and perforated, the sealing and alignment assembly 189, the injection device 188, and the conveyance device 184 may be installed at and/or moved to the selected wellbore 102. Then, the tool string 180 may be conveyed within the wellbore 102 via the pump-down operations and utilized to perform the plug and perf operations.

In certain embodiments, the frac manifold 170 may include an arrangement of flow fittings and manual and remotely actuated fluid flow control valves 173, and may be operable to selectively isolate wellbores 102 by directing the treatment fluid from the common manifold 136 to a selected one or more of the wellbores 102 in which plug and perf operations have been completed and are ready to be fractured. Such operation of the frac manifold 170 (which may be automated or semi-automated, in certain embodiments) may improve the speed of transitioning between wellbores 102, and may reduce or eliminate manual adjustments, which may also reduce safety risks. Thus, the frac manifold 170 may be operable to facilitate "zipper" fracturing operations, which may provide improved (perhaps nearly continuous) utilization of the frac crew and equipment, resulting in substantial improvement to the effective use of the fracturing resources and, thus, to the overall economics of the well.

In certain embodiments, the wellsite system 100 may include one or more control centers 160, each having a controller 161 (e.g., a processing device, a computer, a programmable logic controller (PLC), etc.), which may be operable to monitor and provide control to one or more portions of the wellsite system 100. The controller(s) 161 may monitor and control corresponding equipment of the treatment fluid system, the pump-down system (e.g., the pump unit 190), the plug and perf system (e.g., the conveyance device 184, the tool string 180), and the flow control valve system (e.g., the frac manifold 170, the fluid flow control devices 174, 176). In certain embodiments, the controller(s) 161 may be communicatively connected with the various wellsite equipment described herein, and perhaps other equipment, and may be operable to receive sensor signals from and transmit control signals to such equipment to facilitate automated or semi-automated operations described herein. For example, the controller(s) 161 may be communicatively connected with and operable to monitor and control one or more portions of the mixers 109, 124, the pump units 150, 190, the common manifold 136, the frac manifold 170, the fluid flow control devices 174, 176, the injection device 188, the conveyance device 184, and/or various other wellsite equipment (not shown). The controller(s) 161 may store control commands, operational parameters and set-points, coded instructions, executable programs, and other data or information, including for implementing one or more aspects of the operations described herein. Communication between the control center(s) 160 (and the controller(s) 161) and the various wellsite equipment of the wellsite system 100 may be implemented via wired and/or wireless communication means. For clarity and ease of understanding, such communication means are not depicted, and a person having ordinary skill in the art will appreciate that such communication means are within the scope of the present disclosure.

A field engineer, equipment operator, or field operator 164 (collectively referred to hereinafter as a "wellsite operator") may operate one or more components, portions, or systems of the wellsite equipment and/or perform maintenance or repair on the wellsite equipment. For example, the wellsite operator 164 may assemble the wellsite system 100, operate the wellsite equipment (e.g., via a controller 161) to perform the stimulation operations, check equipment operating parameters, and repair or replace malfunctioning or inoperable wellsite equipment, among other operational, maintenance, and repair tasks, collectively referred to hereinafter as wellsite operations. The wellsite operator 164 may perform wellsite operations by himself or with other wellsite operators.

In certain embodiments, the controller(s) 161 may be communicatively connected with one or more human-machine interface (HMI) devices, which may be utilized by the wellsite operator(s) 164 for entering or otherwise communicating the control commands to the controller(s) 161, and for displaying or otherwise communicating information from the controller(s) 161 to the wellsite operator(s) 164. In certain embodiments, the HMI devices may include one or more input devices 167 (e.g., a keyboard, a mouse, a joystick, a touchscreen, etc.) and one or more output devices 166 (e.g., a video monitor, a printer, audio speakers, etc.). In certain embodiments, the HMI devices may also include a mobile communication device(s) 168 (e.g., a smart phone).

In certain embodiments, one or more of the containers 112, 126, 194, the mixers 109, 124, the pump units 150, 190, the frac manifold 170, the conveyance device 184, and the control center(s) 160 may each be disposed on corresponding trucks, trailers, and/or other mobile carriers 122, 134, 198, 120, 132, 148, 197, 171, 185, 162, respectively, such as may permit their transportation to the wellsite 104. However, in certain embodiments, one or more of the containers 112, 126, 194, the mixers 109, 124, the pump units 150, 190, the frac manifold 170, the conveyance device 184, and the control center(s) 160 may each be skidded or otherwise stationary, and/or may be temporarily or permanently installed at the wellsite 104. In certain embodiments, the common manifold 136 and/or other equipment described herein or otherwise forming a portion of the wellsite system 100 may similarly be mobile, skidded, or otherwise installed at the wellsite 104.

Figure 2:
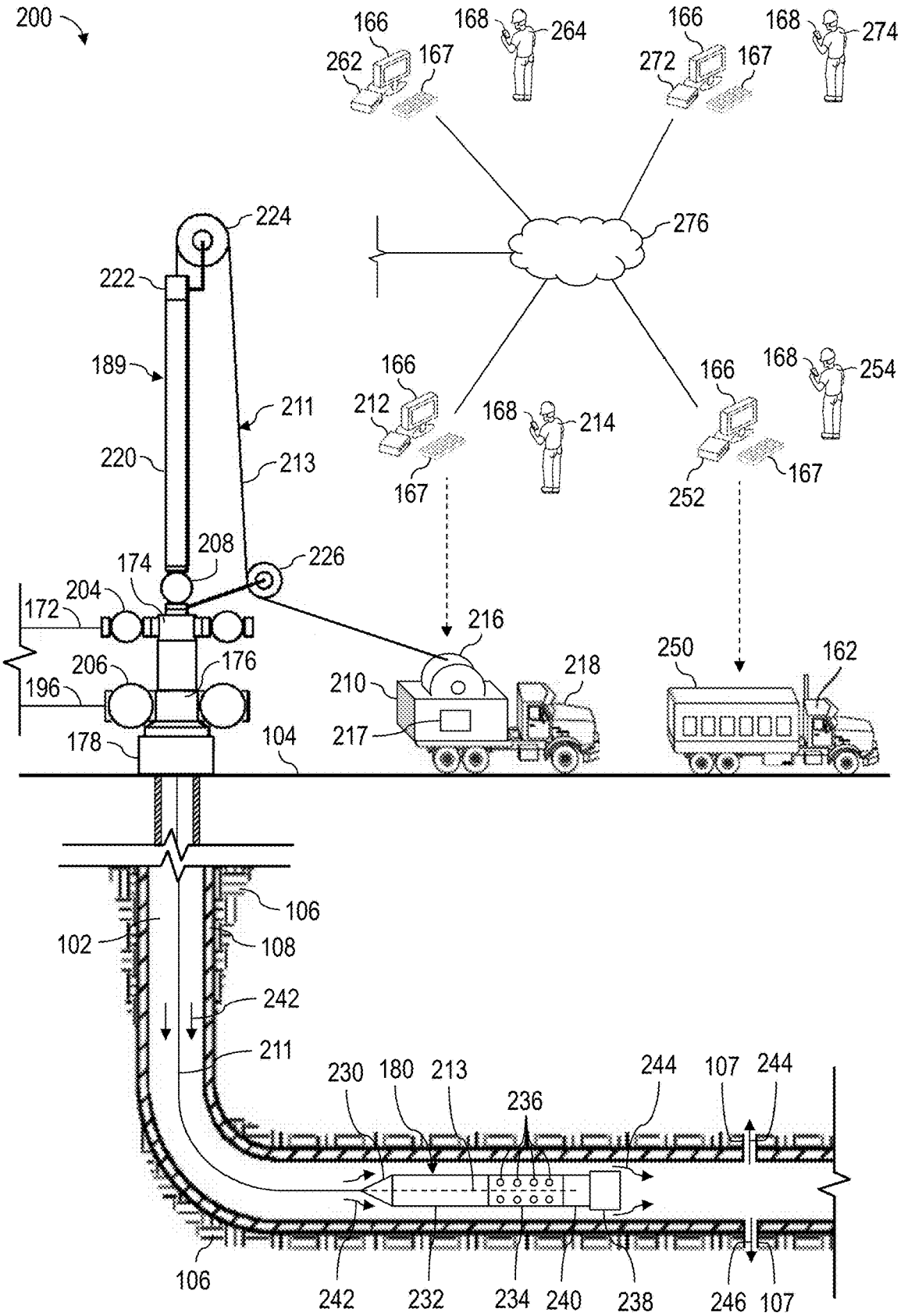
FIG. 2 is a schematic view of a portion of an example implementation of the wellsite system shown in FIG. 1, in accordance with embodiments of the present disclosure.

FIG. 2 is a schematic view of a portion of an example implementation of the wellsite system 100 shown in FIG. 1 and indicated in FIG. 2 by reference numeral 200. The wellsite system 200 shows some of the wellsite equipment of the wellsite system 100 shown in FIG. 1, including where indicated by the same reference numerals. The following description refers to FIGS. 1 and 2, collectively.

The wellsite system 200 includes one of the wellbores 102 extending from the surface of the wellsite 104 into the rock formation 106. In certain embodiments, the wellbore 102 may be capped by the wellhead 178 terminating the wellbore 102 at the surface of the wellsite 104. In certain embodiments, the fluid flow control devices 174, 176 may be mounted on top of the wellhead 178. In certain embodiments, the fluid flow control device 174 may be fluidly connected with the frac manifold 170 via a corresponding conduit 172. In certain embodiments, the fluid flow control device 176 may be fluidly connected with the pump unit 190 via a corresponding conduit 196. In certain embodiments, each fluid flow control device 174, 176 may include a plurality of manually and/or remotely (e.g., electrically, pneumatically, hydraulically) operated (i.e., actuated) fluid flow control valves, each operable to selectively open and close selected tubulars or pipes, such as the casing 108 extending within the wellbore 102, to a corresponding fluid conduit 172, 196. For example, the fluid flow control device 174 may include a remotely operated fluid flow control valve 204 (e.g., a wing valve) remotely operable to fluidly connect the conduit 172 with the wellbore 102 and, thus, fluidly connect the frac manifold 170 with the wellbore 102. In certain embodiments, the fluid flow control device 174 may further include a remotely operated access valve 208 (e.g., swab valve) remotely operable to open top of the fluid flow control device 174 to permit vertical access to the wellbore 102 by a tool string 180. In certain embodiments, the fluid flow control device 176 may include a remotely operated fluid flow control valve 206 (e.g., wing valve) remotely operable to fluidly connect the conduit 196 with the wellbore 102 and, thus, fluidly connect the pump unit 190 with the wellbore 102.

In certain embodiments, the tool string 180 may be conveyed within the wellbore 102 via a conveyance line 211 operably coupled with a winch conveyance device 210. In certain embodiments, the conveyance line 211 may be operably connected with the conveyance device 210 that is operable to apply an adjustable tension to the tool string 180 via the conveyance line 211 to convey the tool string 180 along the wellbore 102. In certain embodiments, the conveyance device 210 may be or include a winch conveyance system including a reel or drum 216 storing thereon a wound length of the conveyance line 211. In certain embodiments, the drum 216 may be rotated by a rotary actuator 217 (e.g., an electric motor, a hydraulic motor, etc.) to selectively unwind and wind the conveyance line 211 to apply an adjustable tensile force to the tool string 180 to selectively convey the tool string 180 along the wellbore 102. In certain embodiments, the conveyance device 210 may be carried by a truck, trailer, or another vehicle 218.

In certain embodiments, the pump unit 190 may be operable to inject a fluid (e.g., water) into each wellbore 102 via the conduits 196 to perform pump-down operations to convey the tool string 180 to an intended depth along the wellbore 102. The pump-down operations may be utilized to move the tool string 180 along the wellbore 102 to facilitate the plug and perf operations. As described herein, the tool string 180 may be conveyed along the wellbore 102 to fluidly isolate an upper portion of the wellbore 102 extending through an upper formation zone that has not yet been perforated from a lower portion of the wellbore 102 extending through a lower formation zone that has already been perforated, and then perforate the upper formation zone.

In certain embodiments, the conveyance device 210 may include a controller 212 communicatively connected with the winch device 210 and the tool string 180, such as may permit the controller 212 to receive sensor signals from and transmit control signals to such equipment to convey the tool string 180 downhole and perform various downhole operations described herein. In certain embodiments, the controller 212 may be electrically or otherwise communicatively connected with the rotary actuator 217 of the drum 216 to selectively unwind and wind the conveyance line 211 to apply an adjustable tensile force to the tool string 180 to selectively convey the tool string 180 into and out of the wellbore 102. In certain embodiments, the controller 212 may be electrically or otherwise communicatively connected with the tool string 180 via a conductor 213 extending through at least a portion of the tool string 180, through the conveyance line 211, and externally from the conveyance line 211 at the surface of the wellsite 104 via a rotatable joint or coupling (e.g., a collector) carried by the drum 216. In certain embodiments, the conductor 213 may transmit and/or receive electrical power, data, and/or control signals between the controller 212 and one or more portions of the tool string 180. In certain embodiments, the controller 212 may be communicatively connected with the tool string 180 and/or various portions thereof, such as various sensors and actuators of the tool string 180, via the conductor 213 to facilitate monitoring and/or control operations of the tool string 180.

The controller 212 may be communicatively connected with one or more HMI devices, which may be utilized by a wellsite operator 214 (e.g., tool string operator, winch conveyance system 210 operator) for entering or otherwise communicating control commands to the controller 212, and for displaying or otherwise communicating information from the controller 212 to the wellsite operator 214. The HMI devices may include one or more input devices 167 and one or more output devices 166. The HMI devices may also include a mobile communication device 168 carried by the wellsite operator 214.

In certain embodiments, the tool string 180 may be deployed into or retrieved from the wellbore 102 through the fluid flow control devices 174, 176, the access valve 208, and a sealing and alignment assembly 189 mounted above the access valve 208 and operable to seal the conveyance line 211 during deployment, conveyance, intervention, and other wellsite operations performed by the tool string 180. In certain embodiments, the sealing and alignment assembly 189 may include a lock chamber 220 (e.g., a lubricator, an airlock, a riser) mounted above the access valve 208, a stuffing box 222 operable to seal around the line 211 at the top of the lock chamber 220, and an injection device 224 (i.e., a pulley) operable to guide the line 211 into the stuffing box 222. In certain embodiments, a guide pulley 226 may guide the line 211 between the injection device 224 and the conveyance device 210. In certain embodiments, the stuffing box 222 may be operable to seal around an outer surface of the line 211, such as via annular packings applied around the surface of the line 211 and/or by injecting a fluid between the outer surface of the line 211 and an inner wall of the stuffing box 222.

In certain embodiments, the conveyance line 211 may be or include a flexible conveyance line, such as a wire, a cable, a wireline, a slickline, a multiline, an e-line, and/or other conveyance means. In certain embodiments, the conveyance line 211 may include one or more metal support wires or cables configured to support the weight of the tool string 180. In certain embodiments, the conveyance line 211 may also include one or more electrical and/or optical conductors 213 operable to transmit electrical energy (i.e., electrical power) and electrical and/or optical signals (e.g., information, data) therethrough, such as may permit the transmission of electrical energy, data, and/or control signals between the tool string 180 and the controller 212.

In certain embodiments, the tool string 180 may include a cable head 230 physically and/or electrically connecting the conveyance line 211 with the tool string 180, such as may permit the tool string 180 to be suspended and conveyed within the wellbore 102 via the conveyance line 211. In certain embodiments, the cable head 230 may provide telemetry and/or power distribution to the tool string 180. The tool string 180 may include at least a portion of one or more downhole devices, modules, subs, and/or other tools 232 operable to perform intended downhole operations. In certain embodiments, the tools 232 of the tool string 180 may include a telemetry/control tool, such as may facilitate communication between the tool string 180 and the controller 212 and/or control of one or more portions of the tool string 180. In certain embodiments, the telemetry/control tool may include a downhole controller (not shown) communicatively connected with the controller 212 via the conductor 213 and with other portions of the tool string 180. In certain embodiments, the tools 232 of the tool string 180 may further include one or more inclination and/or directional sensors, such as one or more accelerometers, magnetometers, gyroscopic sensors (e.g., micro-electro-mechanical system (MEMS) gyros), and/or other sensors for determining the orientation and/or direction of the tool string 180 within the wellbore 102. In certain embodiments, the tools 232 of the tool string 180 may also include a depth correlation tool, such as a casing collar locator (CCL) for detecting ends of casing collars by sensing a magnetic irregularity caused by the relatively high mass of an end of a collar of the casing 108. In certain embodiments, the depth correlation tool may also or instead be or include a gamma ray (GR) tool that may be utilized for depth correlation.

In certain embodiments, the tool string 180 may also include one or more perforating guns or tools 234 operable to perforate or form holes though the casing 108, the cement, and the portion of the formation 106 surrounding the wellbore 102 to prepare the well for fracturing. In certain embodiments, each perforating tool 234 may contain one or more shaped explosive charges 236 operable to perforate the casing 108, the cement, and the formation 106 upon detonation. In certain embodiments, the tool string 180 may also include a plug 238 that may be set at a predetermined position within the wellbore 102, such as to isolate or seal an upper portion (e.g., zone) of the wellbore 102 from a lower portion (e.g., zone) of the wellbore 102 and, in certain embodiments, disconnects the borehole assembly (BHA) from the plug 238. The plug 238 may be permanent or retrievable, facilitating the lower portion (e.g., zone) of the wellbore 102 to be permanently or temporarily isolated or sealed from the upper portion (e.g., zone) of the wellbore 102 before perforating operations. As illustrated in FIG. 2, in certain embodiments, the tool string 180 may also include a separate mechanical reactant delivery assembly 240 (e.g., a canister, in certain embodiments) that may be used to deliver a breakdown fluid separate from the fluids delivered downhole through the one or more perforating guns or tools 234. In addition, as also illustrated in FIG. 2, the tool string 180 may include a mechanical reactant delivery assembly 240 (e.g., including one or more canisters, in certain embodiments) that is configured to facilitate effective fracture initiation, as described in greater detail herein.

In certain embodiments, the treatment fluid system may further include a control center 250 containing a controller 252 (e.g., a processing device, a computer, a PLC, etc.), which may be operable to monitor and provide control to one or more portions of the treatment fluid system. The controller 252 may be communicatively connected with the various equipment of the treatment fluid system and may be operable to receive sensor signals from and transmit control signals to such equipment to facilitate automated or semi-automated operations described herein. For example, the controller 252 may be communicatively connected with and operable to monitor and control one or more portions of the mixers 109, 124, the pump units 150, the common manifold 136, and/or various other wellsite equipment (not shown). The controller 252 may store control commands, operational parameters and set-points, coded instructions, executable programs, and other data or information, including for implementing one or more aspects of the operations described herein. Communication between the control center 250 (and the controller 252) and the various equipment of the treatment fluid system may be implemented via wired and/or wireless communication means. For clarity and ease of understanding, such communication means are not depicted, and a person having ordinary skill in the art will appreciate that such communication means are within the scope of the present disclosure.

In certain embodiments, the controller 252 may be communicatively connected with one or more HMI devices, which may be utilized by a wellsite operator 254 (e.g., fracturing system operator) for entering or otherwise communicating control commands to the controller 252, and for displaying or otherwise communicating information from the controller 252 to the wellsite operator 254. In certain embodiments, the HMI devices may include one or more input devices 167 and one or more output devices 166. In addition, in certain embodiments, the HMI devices may also include a mobile communication device 168 carried by the wellsite operator 254.

In certain embodiments, the pump-down system may further include a controller 262 (e.g., a processing device, a computer, a PLC, etc.) disposed in association with the pump unit 190 and/or fluid container 194. The controller 262 may be operable to monitor and provide control to one or more portions of the pump-down system. The controller 262 may be communicatively connected with the various equipment of the pump-down system and may be operable to receive sensor signals from and transmit control signals to such equipment to facilitate automated or semi-automated operations described herein. For example, the controller 262 may be communicatively connected with and operable to monitor and control one or more portions of the pump unit 190, the fluid container 194, and/or various other wellsite equipment (not shown). The controller 262 may store control commands, operational parameters and set-points, coded instructions, executable programs, and other data or information, including for implementing one or more aspects of the operations described herein. Communication between the controller 262 and the equipment of the pump-down system may be implemented via wired and/or wireless communication means. For clarity and ease of understanding, such communication means are not depicted, and a person having ordinary skill in the art will appreciate that such communication means are within the scope of the present disclosure.

In certain embodiments, the controller 262 may be communicatively connected with one or more HMI devices, which may be utilized by a wellsite operator 264 (e.g., pump-down operator) for entering or otherwise communicating control commands to the controller 262, and for displaying or otherwise communicating information from the controller 262 to the wellsite operator 264. In certain embodiments, the HMI devices may include one or more input devices 167 and one or more output devices 166. In addition, in certain embodiments, the HMI devices may also include a mobile communication device 168 carried by the wellsite operator 264.

In certain embodiments, the wellsite systems 100, 200 may further include a central controller 272 (e.g., a processing device, a computer, a PLC, etc.) operable to monitor and provide control to one or more portions of the wellsite systems 100, 200. The controller 272 may store control commands, operational parameters and set-points, coded instructions, executable programs, and other data or information, including for implementing one or more aspects of the operations described herein. The controller 272 may be communicatively connected with the various equipment of the wellsite systems 100, 200 and may be operable to receive sensor signals from and transmit control signals to such equipment to facilitate automated or semi-automated operations described herein. For example, in certain embodiments, the controller 272 may be communicatively connected with the controller 212 and operable to monitor and control one or more portions of the plug and perf system (e.g., the conveyance device 210, the tool string 180) via the controller 212. In addition, in certain embodiments, the controller 272 may be further communicatively connected with the controller 252 and operable to monitor and control one or more portions of the treatment fluid system (e.g., the mixers 109, 124, the pump units 150) via the controller 252. In addition, in certain embodiments, the controller 272 may be further communicatively connected with the controller 262 and operable to monitor and control one or more portions of the pump-down system (e.g., the pump unit 190, the fluid container 194) via the controller 262. In addition, in certain embodiments, the controller 272 may be further communicatively connected with the fluid flow control devices 174, 176 (e.g., the fluid flow control valves 204, 206) and the access valve 208 associated with each wellbore 102 and the frac manifold 170 (e.g., fluid flow control valves 173), such as may permit the controller 272 to monitor and control the fluid flow control devices 174, 176, the access valves 208, and the frac manifold 170. The controller 272 may, thus, monitor and/or control injection of treatment fluid via the fluid flow control device 174 and injection of water or other fluid via the fluid flow control device 176 into one or more selected wellbores 102.

Communication between the controller 272 and the controllers 212, 252, 262, the fluid flow control devices 174, 176, the access valves 208, and the frac manifold 170 may be implemented via wired and/or wireless communication network 276 (e.g., a local area network (LAN), a wide area network (WAN), the internet, etc.). For clarity and ease of understanding, details of such communication means are not depicted, and a person having ordinary skill in the art will appreciate that such communication means are within the scope of the present disclosure.

In certain embodiments, the controller 272 may be communicatively connected with one or more HMI devices, which may be utilized by a wellsite operator 274 for entering or otherwise communicating control commands to the controller 272, and for displaying or otherwise communicating information from the controller 272 to the wellsite operator 274. In certain embodiments, the HMI devices may include one or more input devices 167 and one or more output devices 166. In addition, in certain embodiments, the HMI devices may also include a mobile communication device 168 carried by the wellsite operator 274. In certain embodiments, the controller 272, the HMI devices 166, 167, and the wellsite operator 274 may be located at the surface of the wellsite 104. For example, the controller 272 may be installed or housed in a control center (e.g., a facility, a trailer, etc.) housing one of the other controllers 212, 252, 262. However, the controller 272, the HMI devices 166, 167, and the wellsite operator 274 may also or instead be located off-site (e.g., a data center) at a distance from the surface of the wellsite 104.

As described herein, the central controller 272 and/or the wellsite operator 274 using the central controller 272 may monitor and provide control to one or more portions of the wellsite systems 100, 200 via direct communication with selected wellsite equipment and/or indirect communication with selected wellsite equipment via dedicated equipment controllers 212, 252, 262 for controlling such wellsite equipment. For example, during pump-down operations, after the tool string 180 is made up and positioned within a selected one of the wellbores 102 below the wellhead 178, the controller 272 and/or the wellsite operator 274 using the controller 272 may initialize operation of the pump unit 190 to pump a fluid (e.g., water) from the fluid container 194. The controller 272 and/or the wellsite operator 274 may also cause the remotely operated fluid valve 206 of the fluid flow control device 176 to open to permit the fluid to be injected into the wellbore 102 containing the tool string 180. The fluid may be injected into the wellbore 102 when the tool string 180 is conveyed within a vertical portion of the wellbore 102 just below the fluid flow control device 176 or when the tool string 180 stops descending within the wellbore 102 by way of gravity. The fluid injected into the wellbore 102 may flow downhole, as indicated by arrows 242, thereby forming an increased pressure zone behind (i.e., uphole from) the tool string 180 that is greater than fluid pressure in front of (i.e., downhole from) the tool string 180. Such pressure differential may push or otherwise impart a downhole-directed force operable to move the tool string 180 in the downhole direction. The fluid flowing downhole 242 may also or instead cause friction or drag while the fluid flows around or past the tool string 180, as indicated by arrows 244. The friction may drag or otherwise impart a downhole-directed force operable to move the tool string 180 in the downhole direction. During the pump-down operations, the fluid passing 244 the tool string 180 may escape from the wellbore 102 into the formation 106 in front of the tool string 180 via previously made perforations 107, as indicated by arrows 246, thereby permitting the fluid pumped into the wellbore 102 to continually flow around or past the tool string 180 until the tool string 180 is conveyed to an intended depth within the wellbore 102.

In certain embodiments, while the fluid is being injected into the wellbore 102 by the fluid pump unit 190 during the pump-down operations, the controller 272 and/or the wellsite operator 274 may operate the conveyance device 210 to selectively rotate the drum 216 to unwind the conveyance line 211 to permit the pumped fluid to move the tool string 180 downward along the wellbore 102 at an intended speed and to an intended depth. In certain embodiments, after the tool string reaches the intended depth, the controller 272 and/or the wellsite operator 274 may shut off the pump unit 190 and close the fluid flow control valve 206.

In certain embodiments, while the fluid is being injected into the wellbore 102 by the fluid pump unit 190 during the pump-down operations, the controller 272 and/or the wellsite operator 274 may also operate the treatment fluid system to mix and pump the treatment fluid, open the fluid flow control valve 204 of the fluid flow control device 174, and operate a corresponding fluid flow control valve 173 of the frac manifold 170 of one or more of the other wellbores 102 not undergoing the pump-down operations to direct the treatment fluid therein.

In certain embodiments, after the plug and perf operations of the wellbore 102 are complete, the controller 272 and/or the wellsite operator 274 may operate the conveyance device 210 to pull the tool string 180 out of the wellbore 102 through the fluid flow control devices 174, 176 and close the access valve 208. Thereafter, the controller 272 and/or the wellsite operator 274 may operate the treatment fluid system to mix and pump the treatment fluid, open the fluid flow control valve 204 of the fluid flow control device 174, and operate a corresponding fluid flow control valve 173 of the frac manifold 170 to direct the treatment fluid into the newly perforated wellbore 102.

In certain embodiments, while the plug and perf operations of the wellbore 102 are being performed, the controller 272 and/or the wellsite operator 274 may also operate the treatment fluid system to mix and pump the treatment fluid, open the fluid flow control valve 204 of the fluid flow control device 174, and operate a corresponding fluid flow control valve 173 of the frac manifold 170 of one or more of the other wellbores 102 not undergoing the plug and perf operations to direct the treatment fluid therein. In certain embodiments, after the plug and perf operations of the wellbore 102 are complete, the central controller 272 and/or the wellsite operator 274 using the central controller 272 may operate the frac manifold 170 to direct the treatment fluid into such wellbore 102 and/or operate the fluid access valve 204 of the fluid flow control device 174 associated with such wellbore 102 to permit the treatment fluid to be injected into the newly perforated wellbore 102.

The present disclosure is further directed to an example monitoring and control system (or apparatus) (hereinafter "control system") for monitoring and controlling various wellsite equipment of the wellsite systems 100, 200 to perform processes, operations, and methods described herein, including the pump-down operations, the plug and perf operations, the stimulation operations, and various fluid valve transition operations that take place between each of the pump-down operations, the plug and perf operations, and the stimulation operations. In certain embodiments, the control system may include a controller, such as the controller 272, operable to receive sensor data from the wellsite equipment of the wellsite systems 100, 200, process such sensor data, and output control signals to such wellsite equipment to implement the example methods, processes, and/or operations described herein.

As described in greater detail herein, the embodiments of the present disclosure include various related innovations for delivering breakdown fluids at downhole locations to initiate improved hydraulic fracturing including, but not limited to, releasing breakdown fluids from a mechanical reactant delivery assembly 240 (e.g., including one or more canisters, in certain embodiments) at a downhole location and mixing the released breakdown fluids with fluids in the wellbore 102 to produce a gel, suspension, or slurry that has higher viscosity than typical pump-down or flush fluids normally present, which may be used to initiate hydraulic fracturing. The embodiments described herein create in situ a high viscosity fluid slug or pill (i.e., the breakdown fluid described herein) across the perforated zone of the well that is to be hydraulically fractured. This pill spearheads the fracturing event. The goal is to create a simple fracture network (e.g., a simple radial fracture) that extends a few feet to a few tens of feet away from the wellbore 102. This will be a relatively clean, low tortuosity flow path that extends further into the formation 106 than what can be achieved solely by the best perforating practices. After this spearhead, the regular slickwater or viscous fracturing fluid may be pumped downhole as usual. Besides having higher viscosity than the normal fluids used to breakdown the formation 106, the breakdown fluid described herein may contain chemicals and additives—such as acids or chelating agents—that assist in the breakdown process and that help create an ideal near wellbore fracture geometry.

Since this breakdown fluid pill fills only a relatively small portion of the wellbore 102 (e.g., at most the last few hundreds of feet above the perforations), it should not create excessive friction pressure when the fracturing treatment commences. Furthermore, since it is only a relatively small volume, it can be designed explicitly for the task of breaking down the formation 106. Other problems that need to be accounted for with fracturing fluids (e.g., friction pressure, formation damage, conductivity damage, cost, and so forth) are minimized.

Placing or creating a breakdown fluid pill immediately across the perforation cluster is a relatively difficult challenge, which is solved by using the embodiments described herein. The basic strategy is to mix the breakdown fluid in situ using a mechanical reactant delivery assembly 240 (e.g., including one or more canisters, in certain embodiments) that is a component of the perforating gun string. The perforating gun 234 is already in the wellbore 102 at the appropriate location when it creates the perforations. The embodiments described herein take advantage of this placement, and by adding a specially designed mechanical reactant delivery assembly 240 attached to or within the perforating gun 234 creates the breakdown fluid at the same location where it will be used.

Mechanical Reactant Delivery Assembly

Figure 3:
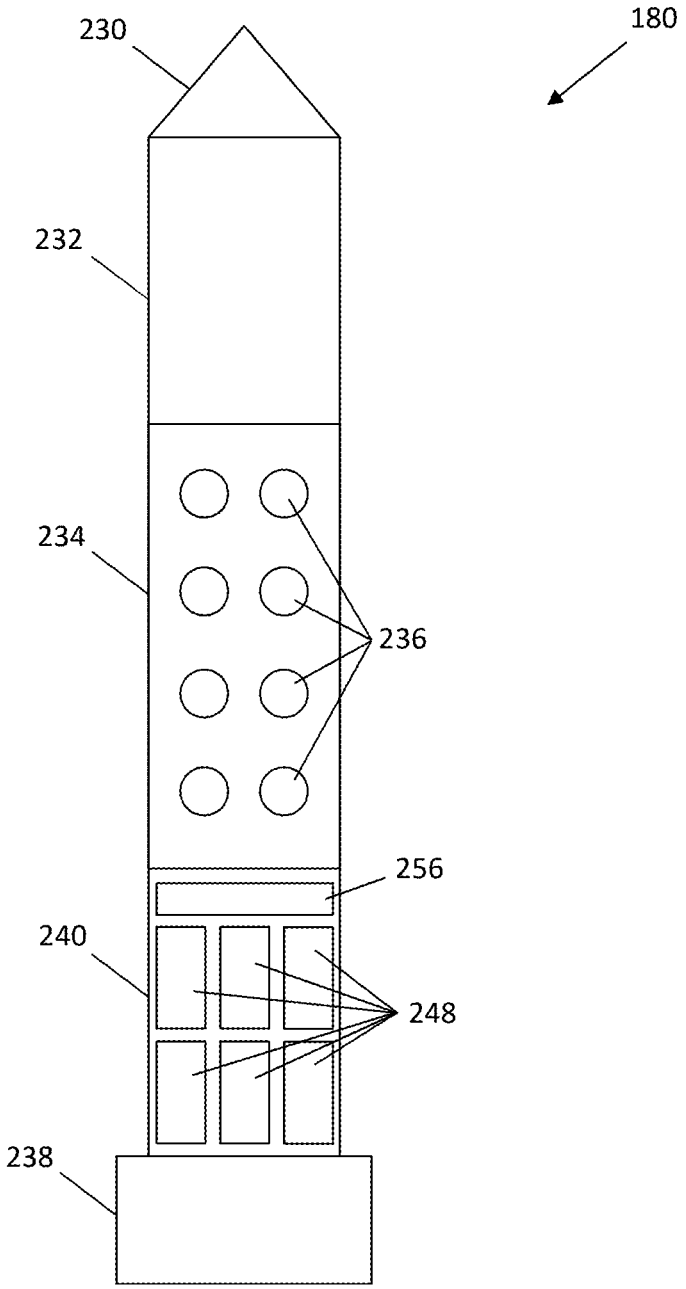
FIG. 3 is a schematic view of an example tool string having a perforating gun and a mechanical reactant delivery assembly, in accordance with embodiments of the present disclosure.

As illustrated in FIG. 3, in certain embodiments, the mechanical reactant delivery assembly 240 may be a part of (or attached to) a perforating gun 234 of a tool string 180. In certain embodiments, the mechanical reactant delivery assembly 240 may include a canister 248 (or a plurality of canisters 248) containing certain chemical reactants. The mechanical reactant delivery assembly 240 may include a single canister 248 or a plurality of canisters 248 containing several different reactants. In addition, the mechanical reactant delivery assembly 240 may include a container having multiple chambers to hold a single or several different reactants. In addition, the mechanical reactant delivery assembly 240 may either be a reusable assembly, a single shot assembly, or a completely disposable self-destructing assembly. In addition, the mechanical reactant delivery assembly 240 may remain attached to the perforating gun 234 or may be detached at a specified location when it is being deployed.

In addition, in certain embodiments, the mechanical reactant delivery assembly 240 may include a device and method of triggering the release of the contents of the canister(s) 248, allowing the respective reactants to be mixed with the fluid surround the perforating gun 234 in the casing 108. For example, in certain embodiments, an explosive charge 236 may be attached to a respective canister 248, which may be wired to detonate in a similar manner as a perforating charge 236. In such embodiments, the charge 236 may rupture a membrane and provide energy to disperse the reactants from an associated canister 248 into the water surrounding the perforating gun 234. However, other types of triggering and opening mechanisms may be used.

In addition, in certain embodiments, the mechanical reactant delivery assembly 240 may be designed for multiple deployment of reactants. For example, one canister 248 of the mechanical reactant delivery assembly 240 containing one material may be triggered first, and mixed with the fluid immediately adjacent to it, and a second canister 248 of the mechanical reactant delivery assembly 240 may be deployed later at a different location.

In addition, in certain embodiments, the mechanical reactant delivery assembly 240 may be equipped with an external mixing assembly 256 such as fins, a propeller, or a static mixer designed to agitate the fluid surrounding it while it is being drawn out of the well. In such embodiments, the mixing assembly 256 may be permanent, disposable, or degradable.

Method of Releasing and Mixing Reactants with Fluid in a Wellbore

In certain embodiments, the mechanical reactant delivery assembly 240 may be used in a sequence of steps to create a breakdown fluid at an appropriate location within the wellbore 102 across the perforation clusters. It also involves appropriate selection of the fluid used to pump down to the guns 234. The method involves coordinating the timing of rupturing of the canister(s) 248 with the firing of the perforation guns 234 so that an ideal breakdown fluid is mixed at the correct location. The canister(s) 248 may be triggered to rupture at various times during the perforating sequence—either before, during, or after the perforation charges 236 are shot. As mentioned above, the process may be one where all the reactants may be released at once, or in a series of separate deployments where canisters 248 may be deployed at different locations along the wellbore 102.

Chemical Compositions

The chemical composition of the reactants, the chemical composition of the fluid used to pump down the perforating gun 234, and the resultant composition of the mixed fluid may be specifically selected based on the particular needs of the perforation operation. As discussed above, the mixed fluid may be called the "breakdown" fluid herein.

In certain embodiments, various chemicals may be used to create a viscous pill including, but not limited to:

1. Water-soluble polymers such as polyacrylamides (PAM), and polyacrylamide polyacrylates, copolymers, poly (2-acrylamido-2-methyl-1-propanesulfonic acid) (AMPS), hydroxyethyl cellulose (HEC), xanthan, diutan, chitosan and chitosan derivatives, guar, and so forth. The specific choice may depend on the expected mix water in the wellbore 102, and the desired properties for the resultant breakdown fluid. For example, chitosan may be used if a relatively low pH is desired for the breakdown fluid.
2. Viscoelastic surfactants
3. Crosslinking agents
4. Reactive species such as pH buffering agents, chelating agents, inorganic or organic acids, inorganic or organic salts, and so forth. These species may be used to assist in the creation of a viscous gel or, alternatively, in the case of acids, may be used to assist in the breakdown of the cement sheath or carbonaceous rock.
5. Superabsorbent particles, such as crosslinked PAM materials.
6. Particulate or colloid material for forming a slurry or suspension. These particles may include bentonite, nanocellulose, fibrous materials, micro-cement, degradable polymers, glass microbubbles, degradable reactive metals, and so forth. The particulates particle size distribution (PSD) and concentration may be set to bridge off microfractures while allowing for main fracture propagation.

It will be appreciated that, in certain embodiments, at least one chemical component from each of these six categories may be used. However, in other embodiments, any and all different combinations of these chemical components may be used.

Method of Initiating Hydraulic Fracturing

Once the pill is placed within the wellbore 102, and the gun 234 is removed from the wellbore 102, the fracturing treatment can begin. Breaking down the formation 106 with a high viscosity pill will be different than breaking down with slickwater. In certain embodiments, the pressure ramp may need to be modified to facilitate breakdown and minimize viscous fingering of the wellbore fluid into the pill.

Follow-Up Fluid

In certain embodiments, a "follow-up" fluid may be pumped in the early stages of the treatment to maximize the performance of the breakdown fluid, and potentially correct for any deleterious effects caused by residual breakdown fluids. One embodiment could be to formulate the pill and the follow-up fluid so that the effects of viscous fingering may be blunted. For example, the follow up fluid could contain excess crosslinking agent so that it will continue to gel residue of the viscous pill as it begins to finger through the pill. One of the advantages of initiating the hydraulic fracture with a small volume fluid pill is that the fluid may be designed exclusively for breakdown. Other issues such as formation damage and fracture cleanup may be ignored since there is so little of this material, and it will generally be swept away by the bulk of the fracturing treatment. However, if desired, clean up additives such as oxidizers, acids, surfactants, and chelating agents may be pumped immediately following breakdown to facilitate removal of these materials.

Figure 4:
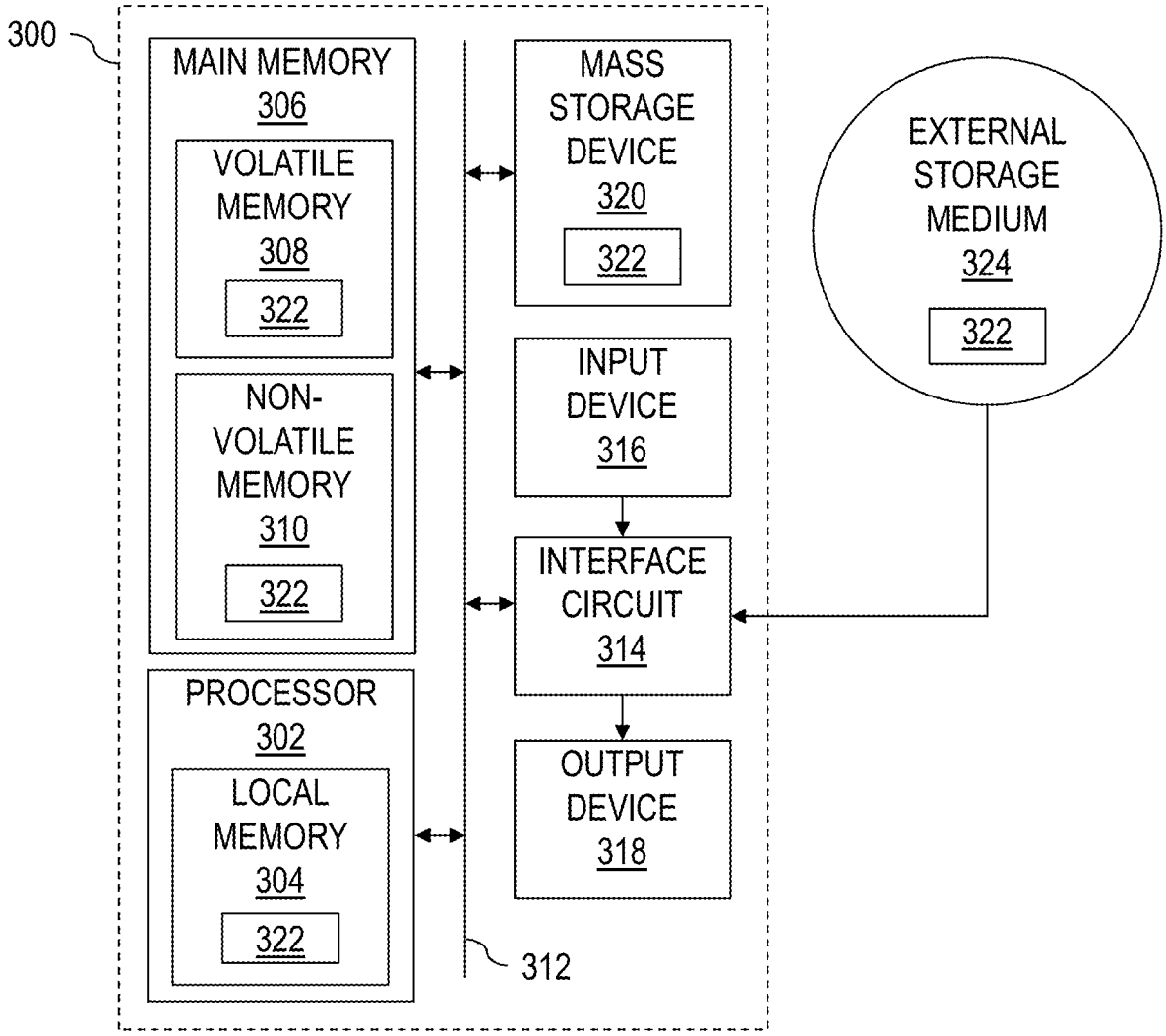
FIG. 4 is a schematic view of at least a portion of a processing device (or system), in accordance with embodiments of the present disclosure.

FIG. 4 is a schematic view of at least a portion of a processing system 300, in accordance with embodiments of the present disclosure. The processing system 300 may be or form at least a portion of one or more processing devices, equipment controllers, and/or other electronic devices shown in one or more of the FIGS. 1 and 2.

In certain embodiments, the processing system 300 may be or include, for example, one or more processors, controllers, special-purpose computing devices, personal computers (PCs, e.g., desktop, laptop, and/or tablet computers), personal digital assistants, smartphones, industrial PCs (IPCs), PLCs, servers, internet appliances, and/or other types of computing devices. In certain embodiments, the processing system 300 may be or form at least a portion of the controllers 161, 212, 252, 262, 272 shown in FIGS. 1 and 2 and/or local controllers associated with one or more instances of the wellsite equipment shown in FIGS. 1 and 2. Although it is possible that the entirety of the processing system 300 may be implemented within one device, it is also contemplated that one or more components or functions of the processing system 300 may be implemented across multiple devices, some or an entirety of which may be at the wellsite and/or remote from the wellsite.

The processing system 300 may include a processor 302, such as a general-purpose programmable processor. The processor 302 may include a local memory 304, and may execute machine-readable and executable program code instructions 322 (i.e., computer program code) present in the local memory 304 and/or another memory device. The processor 302 may execute, among other things, the program code instructions 322 and/or other instructions and/or programs to implement the example methods, processes, and/or operations described herein. For example, the program code instructions 322, when executed by the processor 302 of the processing system 300, may cause the equipment described herein to perform example methods and/or operations described herein. The program code instructions 322, when executed by the processor 302 of the processing system 300, may also or instead cause the processor 302 to receive and process sensor data (e.g., sensor measurements), and output control commands to the wellsite equipment based on programming, predetermined set-points, and the received sensor data.

The processor 302 may be, include, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Examples of the processor 302 include one or more INTEL microprocessors, microcontrollers from the ARM and/or PICO families of microcontrollers, and embedded soft/hard processors in one or more FPGAs.

In certain embodiments, the processor 302 may be in communication with a main memory 306, such as may include a volatile memory 308 and a non-volatile memory 310, perhaps via a bus 312 and/or other communication means. In certain embodiments, the volatile memory 308 may be, include, or be implemented by random-access memory (RAM), static RAM (SRAM), synchronous dynamic RAM (SDRAM), dynamic RAM (DRAM), RAMBUS dynamic RAM (RDRAM), and/or other types of RAM devices. In certain embodiments, the non-volatile memory 310 may be, include, or be implemented by read-only memory, flash memory, and/or other types of memory devices. One or more memory controllers (not shown) may control access to the volatile memory 308 and/or non-volatile memory 310.

In certain embodiments, the processing system 300 may also include an interface circuit 314, which is in communication with the processor 302, such as via the bus 312. In certain embodiments, the interface circuit 314 may be, include, or be implemented by various types of standard interfaces, such as an Ethernet interface, a universal serial bus (USB), a third generation input/output (3GIO) interface, a wireless interface, a cellular interface, and/or a satellite interface, among others. In certain embodiments, the interface circuit 314 may include a graphics driver card. In certain embodiments, the interface circuit 314 may include a communication device, such as a modem or network interface card to facilitate exchange of data with external computing devices via a network (e.g., Ethernet connection, digital subscriber line (DSL), telephone line, coaxial cable, cellular telephone system, satellite, etc.).

In certain embodiments, the processing system 300 may be in communication with various sensors, video cameras, actuators, processing devices, equipment controllers, and other devices of the wellsite systems 100, 200 via the interface circuit 314. The interface circuit 314 may facilitate communications between the processing system 300 and one or more devices by utilizing one or more communication protocols, such as an Ethernet-based network protocol (e.g., ProfiNET, OPC, OPC/UA, Modbus TCP/IP, EtherCAT, UDP multicast, Siemens S7 communication, or the like), a proprietary communication protocol, and/or another communication protocol.

In certain embodiments, one or more input devices 316 may also be connected to the interface circuit 314. The input devices 316 may permit human wellsite operators 164 to enter the program code instructions 322, which may be or include control commands, operational parameters, operational thresholds, and/or other operational set-points. The program code instructions 322 may further include modeling or predictive routines, equations, algorithms, processes, applications, orchestration level programs, and/or other programs operable to perform example methods and/or operations described herein. In certain embodiments, the input devices 316 may be, include, or be implemented by a keyboard, a mouse, a joystick, a touchscreen, a track-pad, a trackball, an isopoint, and/or a voice recognition system, among other examples.

In certain embodiments, one or more output devices 318 may also be connected to the interface circuit 314. The output devices 318 may permit visualization or other sensory perception of various data, such as sensor data, status data, and/or other example data. In certain embodiments, the output devices 318 may be, include, or be implemented by video output devices (e.g., a liquid crystal display (LCD), a light-emitting diode (LED) display, a cathode-ray tube (CRT) display, a touchscreen, etc.), printers, and/or speakers, among other examples. In certain embodiments, the one or more input devices 316 and the one or more output devices 318 connected to the interface circuit 314 may, at least in part, facilitate the HMIs described herein.

In certain embodiments, the processing system 300 may include a mass storage device 320 for storing data and program code instructions 322. The mass storage device 320 may be connected to the processor 302, such as via the bus 312. In certain embodiments, the mass storage device 320 may be or include a tangible, non-transitory storage medium, such as a floppy disk drive, a hard disk drive, a compact disk (CD) drive, and/or digital versatile disk (DVD) drive, among other examples. The processing system 300 may be communicatively connected with an external storage medium 324 via the interface circuit 314. In certain embodiments, the external storage medium 324 may be or include a removable storage medium (e.g., a CD, DVD, or flash disk drive), such as may be operable to store data and program code instructions 322.

As described herein, the program code instructions 322 and other data (e.g., sensor data or measurements database) may be stored in the mass storage device 320, the main memory 306, the local memory 304, and/or the removable storage medium 324. Thus, the processing system 300 may be implemented in accordance with hardware (perhaps implemented in one or more chips including an integrated circuit, such as an ASIC), or may be implemented as software or firmware for execution by the processor 302. In the case of firmware or software, the implementation may be provided as a computer program product including a non-transitory, computer-readable medium or storage structure embodying computer program code instructions 322 (i.e., software or firmware) thereon for execution by the processor 302. The program code instructions 322 may include program instructions or computer program code that, when executed by the processor 302, may perform and/or cause performance of example methods, processes, and/or operations described herein.

Figure 5:
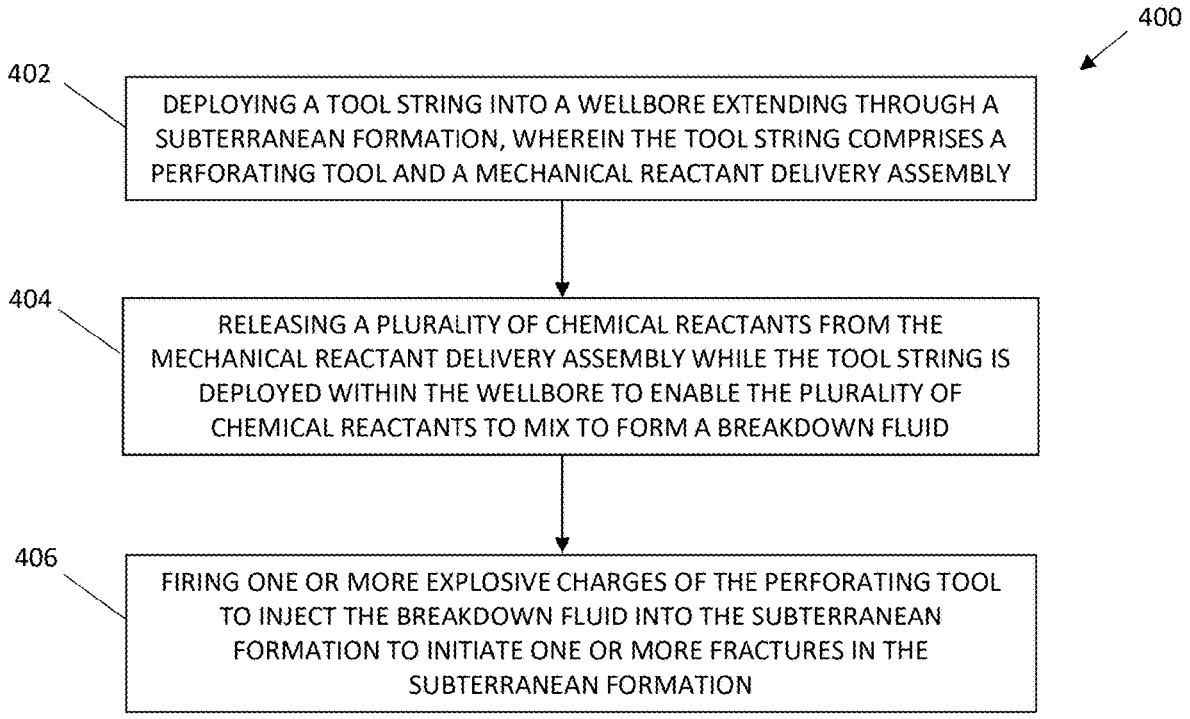
FIG. 5 is a block diagram of a method for facilitating effective fracture initiation, in accordance with embodiments of the present disclosure.

FIG. 5 is a block diagram of a method 400 for facilitating effective fracture initiation, as described in greater detail herein. As illustrated in FIG. 5, in certain embodiments, the method 400 may include deploying a tool string 180 into a wellbore 102 extending through a subterranean formation 106 (block 402). The tool string 180 includes a perforating tool 234 and a mechanical reactant delivery assembly 240. In addition, in certain embodiments, the method 400 may include releasing a plurality of chemical reactants from the mechanical reactant delivery assembly 240 while the tool string 180 is deployed within the wellbore 102 to enable the plurality of chemical reactants to mix to form a breakdown fluid (block 404). In addition, in certain embodiments, the method 400 may include firing one or more explosive charges 236 of the perforating tool 234 to inject the breakdown fluid into the subterranean formation 106 to initiate one or more fractures in the subterranean formation 106 (block 406).

In addition, in certain embodiments, the method 400 may include mixing the plurality of chemical reactants using a mixing assembly 256 of the mechanical reactant delivery assembly 240 to form the breakdown fluid. In addition, in certain embodiments, the method 400 may include coordinating timing of the firing of the one or more explosive charges 236 of the perforating tool 234 based on timing of the mixing of the plurality of chemical reactants.

In addition, in certain embodiments, the method 400 may include pumping a follow-up fluid into the subterranean formation 106 subsequent to injecting the breakdown fluid into the subterranean formation 106. In such embodiments, the breakdown fluid may be configured to produce a gel, suspension, or slurry having a viscosity substantially higher than the follow-up fluid. In addition, the follow-up fluid may include a crosslinking agent configured to continue to gel the breakdown fluid in the subterranean formation 106.

In certain embodiments, the mechanical reactant delivery assembly 240 may include a plurality of canisters 248 configured to store respective reactants of the plurality of chemical reactants prior to release of the plurality of chemical reactants. In addition, in certain embodiments, each canister 248 of the plurality of canisters 248 may be associated with a respective explosive charge 236 of the one or more explosive charges 236 such that the respective chemical reactants are released upon firing of the respective explosive charges 236.

In certain embodiments, the plurality of chemical reactants may include a water-soluble polymer. In addition, in certain embodiments, the plurality of chemical reactants may include a viscoelastic surfactant. In addition, in certain embodiments, the plurality of chemical reactants may include a crosslinking agent. In addition, in certain embodiments, the plurality of chemical reactants may include a reactive species. In addition, in certain embodiments, the plurality of chemical reactants may include superabsorbent particles. In addition, in certain embodiments, the plurality of chemical reactants may include a particulate or colloid material.

The specific embodiments described herein have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A method comprising:

deploying a tool string into a wellbore extending through a subterranean formation, wherein the tool string comprises a perforating tool and a mechanical reactant delivery assembly;

releasing a plurality of chemical reactants from the mechanical reactant delivery assembly while the tool string is deployed within the wellbore to enable the plurality of chemical reactants to mix to form a breakdown fluid;

firing one or more explosive charges of the perforating tool to inject the breakdown fluid into the subterranean formation to initiate one or more fractures in the subterranean formation; and pumping a follow-up fluid into the subterranean formation subsequent to injecting the breakdown fluid into the subterranean formation, wherein the breakdown fluid is configured to produce a gel having a viscosity higher than the follow-up fluid, and wherein the follow-up fluid comprises a crosslinking agent configured to continue to gel the breakdown fluid in the subterranean formation.

2. The method of claim 1, comprising mixing the plurality of chemical reactants using a mixing assembly of the mechanical reactant delivery assembly to form the breakdown fluid.

3. The method of claim 1, comprising coordinating timing of the firing of the one or more explosive charges of the perforating tool based on timing of the mixing of the plurality of chemical reactants.

4. The method of claim 1, wherein the mechanical reactant delivery assembly comprises a plurality of canisters configured to store respective reactants of the plurality of chemical reactants prior to release of the plurality of chemical reactants.

5. The method of claim 4, wherein each canister of the plurality of canisters is associated with a respective explosive charge of the one or more explosive charges such that the respective chemical reactants are released upon firing of the respective explosive charges.

6. The method of claim 1, wherein the plurality of chemical reactants comprises a water-soluble polymer.

7. The method of claim 1, wherein the plurality of chemical reactants comprises a viscoelastic surfactant.

8. The method of claim 1, wherein the plurality of chemical reactants comprises a crosslinking agent.

9. The method of claim 1, wherein the plurality of chemical reactants comprises a reactive species.

10. The method of claim 1, wherein the plurality of chemical reactants comprises superabsorbent particles.

11. The method of claim 1, wherein the plurality of chemical reactants comprises a particulate or colloid material.

* * * * *